US007395862B2

(12) United States Patent
Ross et al.

(10) Patent No.: US 7,395,862 B2
(45) Date of Patent: Jul. 8, 2008

(54) COMBINATION JAR AND DISCONNECT TOOL

(75) Inventors: Richard J. Ross, Houston, TX (US); Dewayne M. Turner, Tomball, TX (US)

(73) Assignee: BJ Services Company, Houston, TX (US)

( * ) Notice: Subject to any disclaimer, the term of this patent is extended or adjusted under 35 U.S.C. 154(b) by 107 days.

(21) Appl. No.: 11/256,306

(22) Filed: Oct. 21, 2005

(65) Prior Publication Data

US 2006/0086505 A1 Apr. 27, 2006

Related U.S. Application Data

(60) Provisional application No. 60/620,865, filed on Oct. 21, 2004.

(51) Int. Cl.
*E21B 31/00* (2006.01)

(52) U.S. Cl. ..... 166/301; 166/178

(58) Field of Classification Search ..... 166/301, 166/376, 55, 178

See application file for complete search history.

(56) References Cited

U.S. PATENT DOCUMENTS 5,103,903 A 4/1992 Marks
5,447,196 A 9/1995 Roberts
5,503,228 A 4/1996 Anderson
5,595,244 A 1/1997 Roberts
5,595,253 A 1/1997 Martin
6,135,217 A 10/2000 Wilson
6,182,775 B1 2/2001 Hipp
6,202,767 B1 3/2001 Friis
6,290,004 B1 9/2001 Evans
6,712,134 B2 3/2004 Stoesz
6,725,932 B2 4/2004 Taylor
6,988,551 B2 1/2006 Evans
7,066,263 B1 6/2006 Mouton
7,111,678 B2 9/2006 McElroy
7,147,060 B2 12/2006 Huber
7,163,058 B2 1/2007 Bakke
7,195,069 B2 3/2007 Roberts
7,264,055 B2 9/2007 Rustom

*Primary Examiner*—Jennifer H. Gay
*Assistant Examiner*—Brad Harcourt
(74) *Attorney, Agent, or Firm*—Locke Lord Bissell & Liddell LLP

(57) ABSTRACT

A combination jarring tool and disconnect device is disclosed in which the jarring events may be followed by separate disconnect event, or in which the jarring events may coincide with disconnect events. The tool generally comprises a housing and a sleeve in concentric arrangement and a disconnect interface. A plurality of axial and rotational locks is used to prevent premature energization of the jarring and disconnect events.

19 Claims, 4 Drawing Sheets

COMBINATION JAR AND DISCONNECT TOOL

CROSS REFERENCE TO RELATED APPLICATIONS

This application claims the benefit of U.S. application Ser. No. 60/620,865, filed on Oct. 21, 2004, which is incorporated by reference herein.

STATEMENT REGARDING FEDERALLY SPONSORED RESEARCH OR DEVELOPMENT

Not applicable.

REFERENCE TO APPENDIX

Not applicable.

BACKGROUND OF THE INVENTION

1. Field of the Invention

This invention relates generally to a tool useful in the oil and gas industry to free and/or disconnect from equipment stuck in a subterranean well, and more particularly to a tool for jarring loose stuck equipment and/or disconnecting from equipment.

2. Description of the Related Art

It is not surprising that tools and equipment used in drilling subterranean oil and gas wells sometimes become stuck downhole. Generally, as a well's depth increases so does its deviation from straight or at least from the intended path. When a tool or other piece of equipment becomes stuck downhole, the art provides various devices to unstick the tool or, oftentimes as a last result, to disconnect from the stuck tool.

This application for patent discloses and claims an improved combination jar or bumper tool and disconnect device.

BRIEF SUMMARY OF THE INVENTION

A tool is provided comprising a first portion having threads of a first hand on one end for mating with another tool and threads of an opposite hand on the other end. A housing is provided having a first hand threaded end for mating with yet another tool. A sleeve is located adjacent the housing and has an opposite hand threaded end mated to the end of the first portion, which has threads of opposite hand. The housing and sleeve share an axial locking element that fixes the sleeve to the housing against relative axial movement and share at least one anti-rotation element to prevent relative rotation between the sleeve and the housing. The first portion and the sleeve share a rotational locking element that fixes the sleeve to the first portion against relative rotation. The axial locking element between the housing and sleeve may be unlocked to allow the sleeve to move relative to the housing to impart a jarring force to the first portion and the rotational locking element may be unlocked so that rotation of the sleeve in a first hand tightening direction disconnects the first portion from the housing

Figure 1:
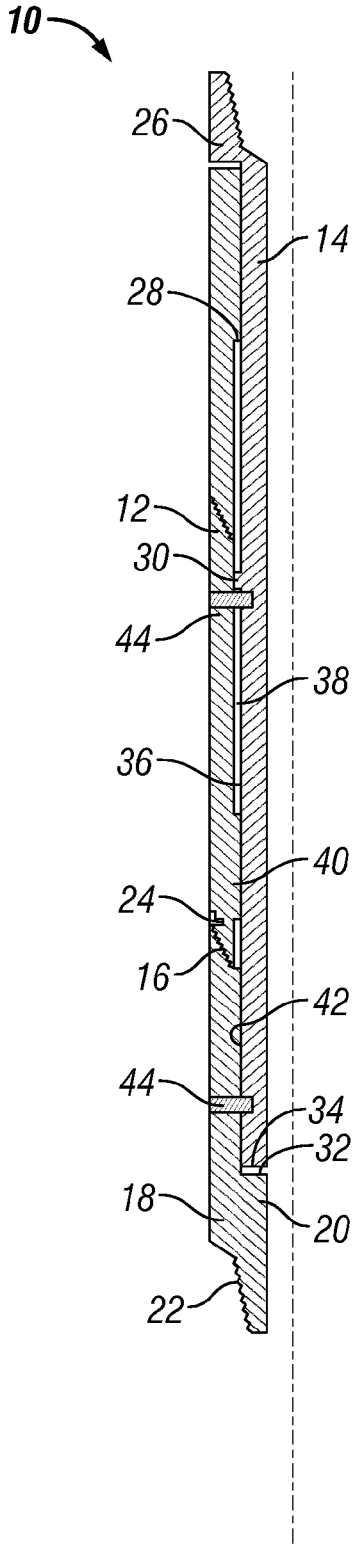
FIG. 1 illustrates an embodiment of the present invention enabling sequential jar and disconnect events.

While the inventions disclosed herein are susceptible to various modifications and alternative forms, only a few specific embodiments have been shown by way of example in the drawings and are described in detail below. The figures and detailed descriptions of these specific embodiments are not intended to limit the breadth or scope of the invention or the appended claims in any manner. Rather, the figures and detailed written descriptions are provided to illustrate how to make and use an embodiment of the invention to persons skilled in the art.

DETAILED DESCRIPTION

One or more illustrative embodiments incorporating the invention disclosed herein are presented below. Not all features of an actual implementation are described or shown in this application for the sake of clarity. For example, the various seals, vents and others design details common to this type of oil well tool are not specifically illustrated or described. It is understood that in the development of an actual embodiment incorporating the present invention, numerous implementation-specific decisions must be made to achieve the developer's goals, such as compliance with system-related, business-related, government-related and other constraints, which vary by implementation and from time to time. While a developer's efforts might be complex and time-consuming, such efforts would be, nevertheless, a routine undertaking for those of ordinary skill the art having benefit of this disclosure.

In general terms, Applicants have created a combination jar and disconnect tool for use in freeing tools stuck downhole and/or disconnecting from stuck tools. The invention may be implemented in numerous embodiments, two of which may be described as a sequential actuation embodiment and a parallel actuation embodiment. An embodiment of the invention, such as a combination tool, may generally comprise a housing, a sleeve substantially concentric with the housing, a disconnect joint and a jarring element between the housing and sleeve. Preferably, the combination tool is placed up-hole, and more preferably immediately up-hole, from the equipment of interest, such as a gravel pack tool. If the gravel pack tool becomes stuck, the combination tool may be energized to try to jar or bump loose the stuck tool, and/or to disconnect from the stuck tool.

As a general description of a sequential actuation embodiment, the combination tool may be energized, such as by tension or pressure, to release one or more axial locks between the tool housing and sleeve. Once the axial lock or locks have been released, the combination tool may be used as a jar or bumper to impart a dynamic load to the stuck tool to hopefully release it from its stuck condition. The combination tool may also comprise an anti-rotation device that prevents relative rotation between the housing and the sleeve. Preferably, the combination tool prevents relative rotation at least when the combination tool is at or near the down-jar position and allows relative rotation when the tool is at the fully up-jar position. A second anti-rotation device, such as a rotational lock, may be provided adjacent the disconnect joint to prevent the disconnect joint from prematurely opening. The disconnect joint is adapted to disconnect through application of rotary motion to one portion of the disconnect joint. In a preferred embodiment, once it has been determined that the stuck tool cannot be jarred loose, or whenever the decision is made to disconnect from the stuck tool, the combination tool is moved to the up-jar position, thereby defeating the first anti-rotational device's prohibition against relative rotational movement between the housing and sleeve. Next, the combination tool is energized, such as by unidirectional rotation, to cause the second anti-rotational device to unlock. Rotation of the tool in a specific direction, such as right hand rotation, will cause relative rotation in the disconnect, thereby disconnecting the upper string from the stuck tool.

As a general description of a parallel actuation embodiment, the combination tool may be energized, such as by tension and/or pressure, to release one or more axial locks between the tool housing and sleeve. Once the axial lock or locks have been released, the combination tool may be used as a jar or bumper to impart a dynamic load to the stuck tool to hopefully release it from its stuck condition. In contrast to the sequential actuation embodiment generally described above, the parallel actuation embodiment includes a motor or transducer that converts the relative axial movement between the tool housing and the sleeve into rotational motion for energizing the disconnect joint. For example, in a preferred embodiment, the motor or transducer may be one or more sets of camming surfaces adapted such that the up-jar stroke of the combination tool generates an incremental amount of relative rotational motion at the disconnect joint and/or the down-jar stroke generates an incremental amount of relative rotational motion. Thus, at the same time that the combination tool is attempting to jar loose the stuck tool, the disconnect joint is being opened to ultimately disconnect the upper string from the struck tool Turning now to FIG. 1, a more detailed description of one embodiment of the invention in the form of a sequential actuation combination tool will be presented. The combination tool 10 illustrated in FIG. 1 generally comprises a housing 12, a sleeve 14 and a disconnect joint 16.

The housing 12 may comprise multiple sections threaded or otherwise fixed together. The housing 12 illustrated in FIG. 1 comprises a first portion 18 having a pin end 20. The pin end 20 has conventional threads 22 of a first hand, typically right hand threads. The first portion 18 may also include a portion of the disconnect joint 16.

In the particular embodiment illustrated in FIG. 1, the disconnect joint 16 comprises a two-part threaded connection with threads having a hand opposite to that of threads 22. More plainly, if the threads 22 of the pin end 20 are right-handed threads, then the threads of the disconnect joint 16 are preferably left-handed. More specifically, the disconnect threads may be 6 pitch, left-handed, ACME threads. The other half of the disconnect joint 16 may be located on another portion of the housing 12 as illustrated in FIG. 1. An anti-rotation device 24, such as a shear pin, a releasable dog, a piston, a sleeve, or the like, is disposed adjacent the disconnect joint 16 such that the two parts of the joint 16 are locked against relative rotation.

In the embodiment illustrated in FIG. 1, the sleeve 14 is internal to and substantially concentric with the housing 12. The sleeve 14 may comprise multiple sections threaded or otherwise fixed together. One end of the sleeve 14 may comprise a box end 26 having threads of the same hand as the threads 22 of the pin end 20. The housing 12 and sleeve 14 may have a plurality of cooperating jarring surfaces or shoulders. For example, in the embodiment illustrated in FIG. 1, the housing 12 has an up-jar shoulder 28 and the sleeve 14 has a cooperating up-jar shoulder 30. The housing 12 and sleeve 14 may also have cooperating down-jar shoulders 32 and 34.

The sleeve 14 and housing 12 share an anti-rotation device 36 that prevents undesired relative rotation between the sleeve 14 and housing 12. As illustrated in FIG. 1, the anti-rotation device 36 may comprise a portion of the outer surface of the sleeve 14 and one or more inner surface portions of the housing 12. More specifically, a portion 38 of the sleeve 14 of the preferred embodiment illustrated in FIG. 1 is a multi-sided, such as hexagonal, mandrel. The housing 12 has one or more corresponding multi-sided bushings 40. As illustrated in FIG. 1, the preferred embodiment has one bushing 40 disposed on one side (e.g., uphole) of the disconnect joint 16 and another bushing 42 disposed on another side of the joint (e.g., downhole). It will now be appreciated that when the housing 12 and sleeve 14 are in the down-jar position, that is when down-jar shoulders 32 and 34 are proximate one another, all portions of the housing 12 including the disconnect joint 16 are restrained from rotation relative to the sleeve 14 by anti-rotation device 36.

While the anti-rotation device 36 of the preferred embodiment has been described and illustrated as a hexagonal mandrel 38, it will be appreciated that the device 36 may take numerous other forms. For example, the device 36 may comprise a mandrel having a triangular, square, star, octagonal or other cross sectional shape adapted to transmit the required torque to the housing 12 through the corresponding portions of the device 36 on the housing 12, and prevent relative rotation as described above.

As described above, the preferred embodiment illustrated in FIG. 1 comprises bushings 40, 42 on either side of the disconnect joint 16. It will be appreciated that if the sleeve 14 is moved axially relative to the housing 12 (see FIG. 2) such that the hex mandrel 38 has disengaged from the bushing 42 on the downhole side of the disconnect joint 16, then relative rotation at the disconnect joint 16 is possible (unless restrained by rotational lock 24). To prevent unintended axial movement of the sleeve 14 relative to the housing 12, one or more axial locks 44 are interposed between the housing 12 and the sleeve 14. The axial lock 44 may take a variety of forms such as a shear pin, a tension ring, a releasable dog, a piston, a sleeve, or the like. In the preferred embodiment illustrated in FIG. 1, the axial lock 44 is one or more shear pins. It will also be appreciated that the axial lock 44 may also function as a rotational lock and supplement or supplant anti-rotational device 36.

Having now described and illustrated the main components of a preferred embodiment of a sequential actuation combination tool 10, Applicants will now illustrate and describe how the combination tool 10 may be used. In an oil well operation, such as gravel packing, a combination jar and disconnect tool, such as the tool 10 described above, may be placed in the string immediately uphole from the gravel pack tool (not shown). The tool 10 is installed in the string in the condition illustrated in FIG. 1. That is, the tool 10 is locked in the down-jar position by an axial lock 44, the disconnect joint 16 is locked together by an anti-rotation device 24, and relative rotation within the tool 10 is prevented by the anti-rotation device 36.

Figure 2:
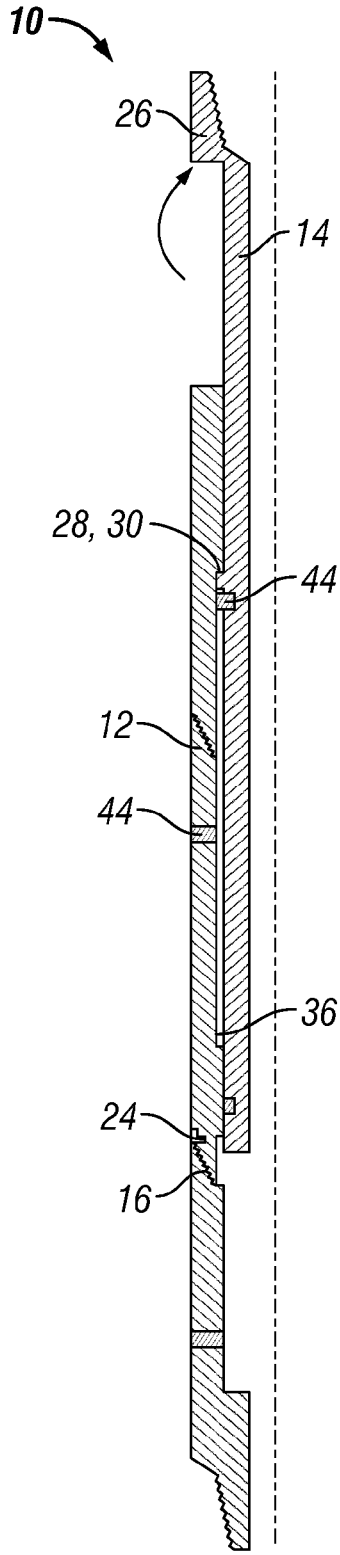
FIG. 2 illustrates the embodiment shown in FIG. 1 prior to initiation of the disconnect sequence.

Assume that the gravel pack tool or other tool or equipment downhole from the combination tool 10 becomes stuck. The sequential combination tool can be energized to impart a jarring force to the stuck string. By applying tension to the stuck string, the operator can cause the axial lock 44 to open. In a preferred embodiment, the axial lock 44 is designed to unlock at about 100 to 200 kips. As illustrated in FIG. 2, once the operator has determined that the axial lock 44 has opened, the sleeve 14 is free to slide relative to the stuck housing 12 within the limits of travel designed into the tool 10. In the preferred embodiment illustrated in FIG. 1, the tool 10 has an axial travel limit (jar travel) of about 18 inches. The operator may now impart an unlimited number of jarring actions, including up-jar forces and/or down-jar forces in attempting to free the stuck string.

If the jarring actions are unsuccessful, the operator may energize the combination tool 10 to disconnect from the stuck string. With the tool 10 in the up-jar position (i.e., when the up-jar shoulders 28, 30 are proximate one another), the anti-rotation device 36 may be unlocked. Of course, the anti-rotation device 36 may be unlocked at axial locations other than the fully up-jar position alone. Once the anti-rotation device 36 is unlocked, the operator may apply a torque to the box end 26 of the tool 10 sufficient to unlock rotational lock 24. In the preferred embodiment illustrated in FIGS. 1 and 2, the rotational lock 24 is one or more pins that shear at a predetermined torque or load.

Once the rotational lock 24 is defeated, rotation of the box end 26 in a direction opposite the hand of the disconnect joint 16 threads separates the combination tool 10 at the joint 16. In the preferred embodiments illustrated in FIGS. 1 and 2, the Operator rotates the box end in a clockwise direction with an amount of torque sufficient to open the rotational lock 24 and continued rotation in a clockwise direction unscrews the disconnect joint 16. The now separated combination tool 10 can be tripped from the well and other well services, such as fishing or milling through the stuck components, can be implemented.

Figure 3:
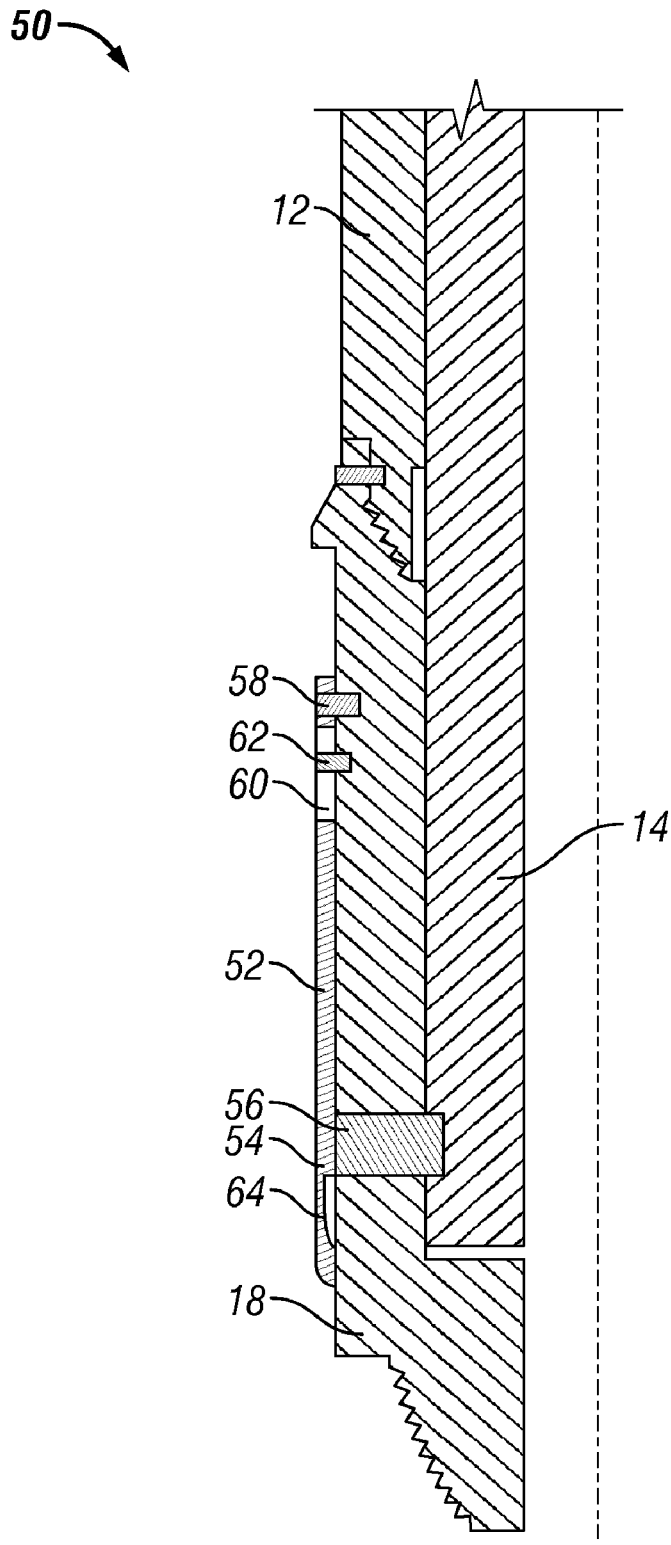
FIG. 3 illustrates an alternate embodiment of the first portion shown in FIG. 1.

FIG. 3 illustrates an alternative to the axial lock 44 illustrated in FIGS. 1 and 2. Axial lock 50 generally comprises a pressure actuated dog assembly. A piston sleeve 52 may be slidably located on a first portion 18 of the housing 12. The piston 52 has a locking portion 54 that cooperates with one or more releasable dogs 56 to lock the sleeve 14 to the housing 12 (here, first portion 18 of housing 12). One or more pins 58 or other similar locking structure may be used to hold the piston 52, and more particularly the locking portion 54 of piston 52 proximate the dog 56. The piston 52 may also comprise one or more axial movement windows 60 and corresponding guide pins 62. Lastly, piston 52 comprises a release portion 64.

In use, the Operator may unlock the axial lock 50 illustrated in FIG. 3 by increasing the annulus pressure to an amount sufficient to cause piston 52 to shear pins 58. Once sheared, the piston 52 may travel upward until the release portion 64 is proximate the dog 56. The releasable dog 56 is outwardly biased such that it releases sleeve 14 from its locked position, which may be axially, rotationally or both. In a preferred embodiment, but not in all embodiments, the releasable dog 56 and the release portion 64 cooperate in such a manner that once the dog 56 has been released it cannot re-lock the sleeve 14.

It now will be appreciated by those of ordinary skill in the art having the benefit of this disclosure that the axial lock 50 illustrated in FIG. 3 may be used in conjunction with or instead of the axial lock 44 illustrated in FIGS. 1 and 2. In a preferred embodiment, the combination tool comprises a pressure actuated axial lock 50 and an axial lock 44. In such embodiment the force required to defeat axial lock 44 may be reduced to about 50 to 200 kips because of the presence of axial lock 50. It will also be appreciated that the axial lock 50 may be implemented as a pressure actuated rotational lock instead of or in combination with rotational lock 24 or anti-rotational device 36. It will also be appreciated that, while the embodiment illustrated in FIG. 3 is energized by annulus pressure, tubing pressure, a combination or differential of tubing and annulus pressure, or a control line may be used to energize such lock.

Figure 4:
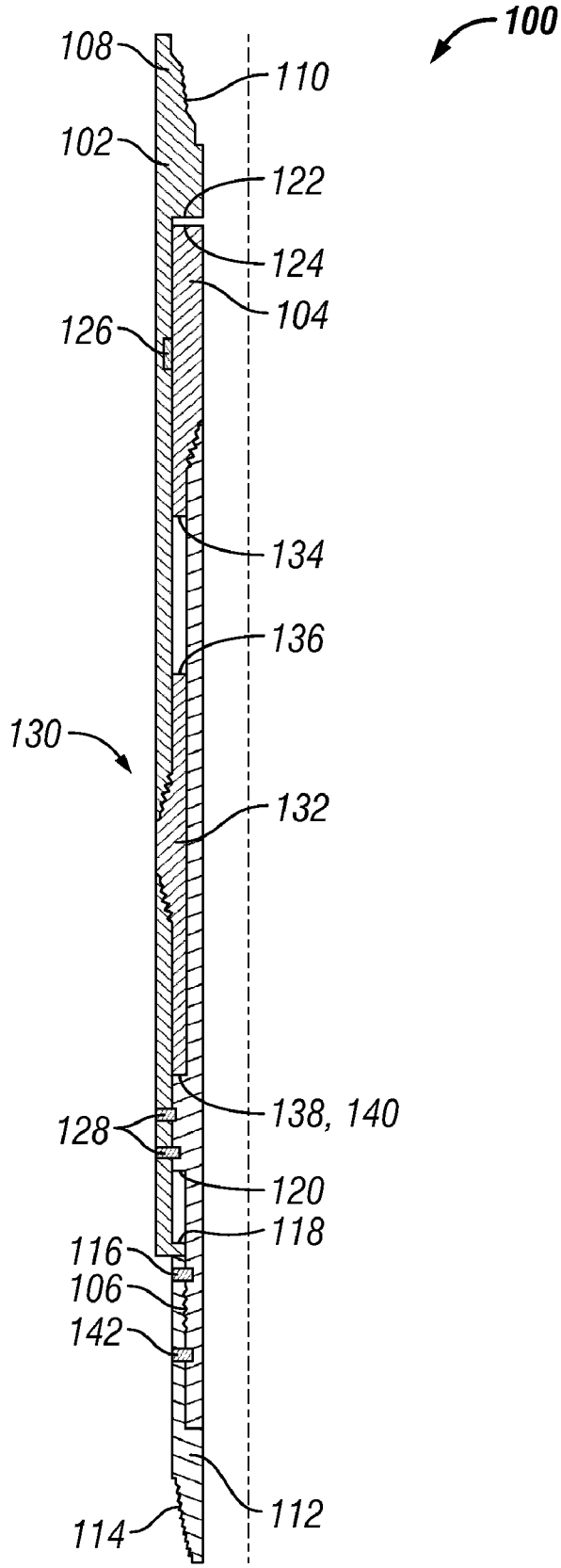
FIG. 4 illustrates another embodiment of the present invention enabling parallel jar and disconnect events.

FIG. 4 illustrates an embodiment of the invention in the form of a parallel actuation combination jar and disconnect device. The parallel actuation combination tool 100 illustrated in FIG. 4 generally comprises a housing 102, a sleeve 104 and a disconnect joint 106. The housing 102 may comprise multiple sections threaded or otherwise fixed together. The housing 102 illustrated in FIG. 4 comprises a box end 108 having conventional threads 110 of a first hand, typically right hand threads.

In the embodiment illustrated in FIG. 4, the sleeve 104 is internal to and substantially concentric with the housing 102. The sleeve 104 may comprise multiple sections threaded or otherwise fixed together. One end of the sleeve 104 may comprise a first portion 112 having a pin end 114 with threads of the same hand as the threads 110 of the box end 108. The first portion 112 may also include a portion of the disconnect joint 106.

In the particular embodiment illustrated in FIG. 4, the disconnect joint 106 comprises a two part threaded connection with threads having a hand opposite to that of threads 112. For example, if the threads 110 of box end 108 and pin end 114 are right-handed threads, then the threads of disconnect joint 106 may be left-handed. More specifically, the disconnect joint 106 threads may be 6 pitch, left-handed, ACME threads. The other half of the disconnect joint 106 may be located on another portion of the sleeve 104 as illustrated in FIG. 4. An anti-rotation device 116, such as a shear pin, a releasable dog, a piston, a sleeve, or the like, is disposed adjacent the disconnect joint 106 such that the joint 106 is locked against relative rotation.

The housing 102 and sleeve 104 may have a plurality of cooperating jarring surfaces or shoulders. For example, in the embodiment illustrated in FIG. 4, the housing 102 may have an up-jar shoulder 118 and the sleeve may have an cooperating up-jar shoulder 120. The housing 102 and sleeve 104 may also have cooperating down-jar shoulders 122 and 124. As illustrated FIG. 4, the tool 100 is in the down-jar position. One or more axial locks 126 may be used to lock the housing 102 and the sleeve 104 in the down-jar position. In the preferred embodiment illustrated in FIG. 4, the axial lock 126 is a tension ring and axial locks 128 are shear pins. The various axial locks described with respects to FIGS. 1-3 may be used with this embodiment as well.

Combination tool 100 also comprises a motor or transducer 130 for converting relative axial movement between the housing 102 and sleeve 104 into rotational motion for energizing the disconnect joint 106. In the embodiment illustrated in FIG. 4, the motor 130 comprises shuttle portion 132, and camming surfaces 134, 136, 138 and 140. Shuttle portion 130 may be a part of the housing 102 and, when the tool 100 is energized for axial movement (i.e. jarring events), the shuttle portion 130 travels with the housing 102. At each end of the shuttle portion 130 are camming surfaces 136 and 138. Each of these surfaces cooperates with corresponding camming surfaces 134 and 140, respectively, on sleeve 104. In the down-jar position, (illustrated in FIG. 4) camming surfaces 138 and 140 are engaged. In the up-jar position, camming surfaces 134 and 136 are engaged. The camming surfaces are structured such that on each engagement, the sleeve 104 is rotated relative to the housing 102 an incremental amount. In the preferred embodiment, each engagement accounts for about 10 degrees of relative rotation. For a disconnect joint employing left-handed threads, the rotational motor 130 should produce right-handed rotation to energize the disconnect joint 106.

Figure 5:
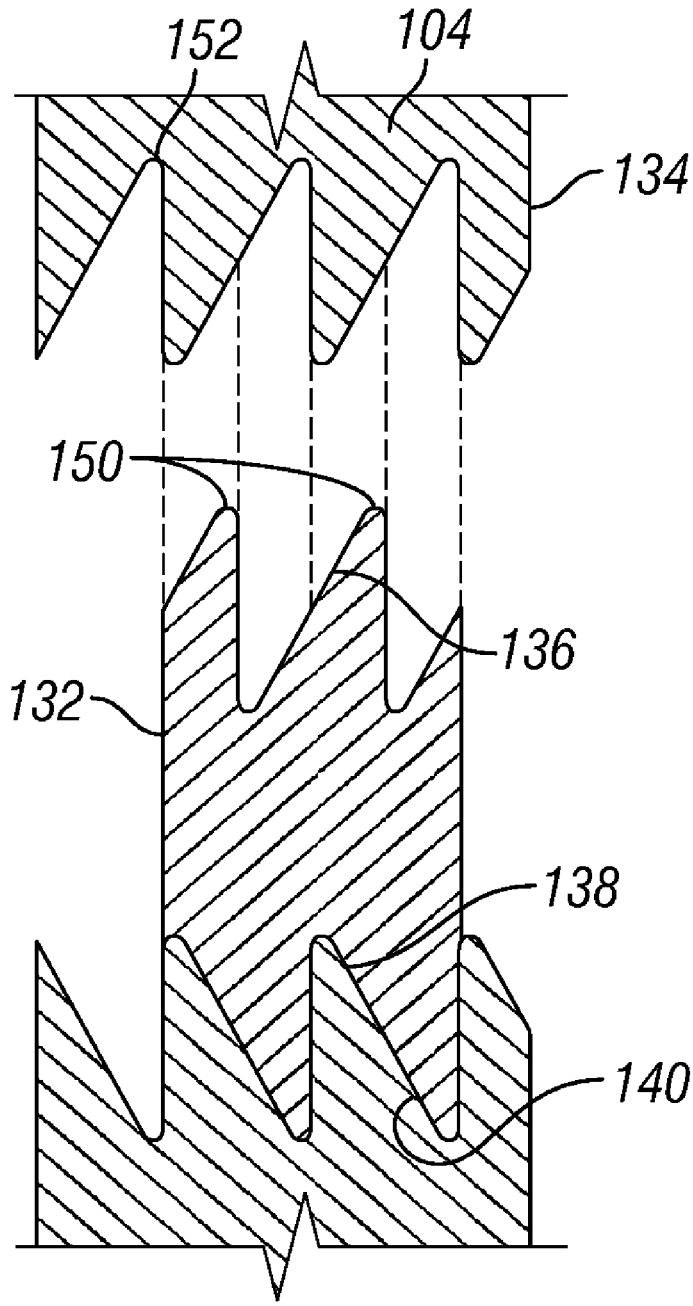
FIG. 5 illustrates a preferred embodiment of the rotational transducer implemented in the embodiment illustrated in FIG. 4.

FIG. 5 illustrates an embodiment of the rotational motor 130 that may be used with the combination tool 100. Shuttle portion 132 is represented in FIG. 5 as having camming surfaces 136 and 138 thereon. Camming surfaces 134 and 140 are shown and are understood to be disposed on the sleeve 104 as illustrated in FIG. 4. FIG. 5 illustrates the motor 130 in the down-jar position. It will be appreciated that as shuttle portion 132 moves axially relative to the sleeve 104, the tips 150 of surfaces 136 will contact flanks 152 of surfaces 134. Continued axial travel in the up-jar direction will cause surfaces 134, and therefore sleeve 104 and the upper portion of disconnect joint 106 to rotate an incremental amount the clockwise direction. A subsequent down-jar stroke will cause the upper portion of disconnect joint 106 to rotate an additional incremental amount in the same direction. The embodiments of FIGS. 4 and 5 have illustrated separate camming and jarring surfaces. These systems can be designed to accomplish what may be describe as soft rotation in that the incremental rotation is accomplished prior to and, preferably, immediately prior to the hard landing on the jarring shoulders. Alternatively, the invention contemplates that the camming surfaces and jarring shoulders may be combined.

Having now described and illustrated the main components to a preferred embodiment of a parallel actuation combination tool 100, Applicants will now describe how the combination tool 100 may be used. In an oil well operation, such as gravel packing, a combination jar and disconnect tool, such as the tool 100 described above, may placed in the string immediately uphole from the gravel pack tool (not shown). The tool 100 is installed in the string in the condition illustrated in FIG. 4. That is, the tool 100 is locked in the down-jar position by one or more axial locks 126 and 128 and the disconnect joint 106 is locked together by anti-rotation device 116.

Assume now that the gravel pack tool or other tool or equipment downhole from the combination tool 100 becomes stuck. The parallel combination tool 100 can now be energized to impart a jarring force to the stuck string and simultaneously incrementally open the disconnect joint 106. By applying tension to the stuck string, the operator can cause the axial locks 126 and/or 128 to open. In a preferred embodiment, the axial locks 126 and 128 are designed to unlock at about 100 to 200 kips. Similarly to that illustrated in FIG. 2, once the operator has determined that the axial locks have opened, the housing 102 is free to slide relative to the stuck sleeve 104 within the limits of travel designed into the tool 100. In the preferred embodiment illustrated in FIG. 4, the tool 100 has an axial travel limit (jar travel) of about 6 inches. The operator may now impart an limited number of jarring actions, including up-jar forces and/or down-jar forces in attempting to free the stuck string.

In the embodiment illustrated in FIG. 4, the first up jar stroke or first several up-jar and down-jar strokes defeat the rotation lock 116 and begin the separation process at disconnect joint 106. Each up-jar stroke and each down-jar stroke causes the motor 130 to rotate the upper portion of the disconnect joint 106 relative to the stuck lower portion of the joint. The number of strokes needed to open the disconnect joint 106 is a matter of design choice and may be implemented by the number of engaged threads of disconnect joint 106 and the incremental rotation generated by the motor 130 per stroke. In the preferred embodiment, once the Operator has opened the disconnect joint 106, the Operator must overcome a secondary axial lock 142, such as a shear pin, to fully separate the combination tool 100. Alternatively, if the string becomes unstuck during the jarring events, but before the disconnect joint 106 is fully opened, the secondary axial lock 142 is designed to allow the operator to trip out the entire string.

In the event that frictional, inertial or other forces cause the relative rotation generated by the motor 130 to back off during a subsequent stroke, one-way rotation locks between the housing 102 and sleeve 104 may be used. For example, a pin/follower system or circumferentially oriented unidirectional chevrons may be used to prevent the relative rotation generated by the motor 130 from backing off during subsequent jarring strokes.

It will be appreciated by those of ordinary skill this art having the benefit of this disclosure that features illustrated with respect to one embodiment described herein may have application or utility with another embodiment described herein or with another embodiment of the invention inspired by this disclosure. For example, the embodiments illustrated herein have been described in terms of a housing and a sleeve each having identifiable structural and functional attributes and characteristics. It is well within the scope of the invention conceived by Applicant's to interchange or swap one or more function or structure between the housing and the sleeve. Further, relative terms, such as up, down, left, right, top and bottom, are not meant to be limiting in any manner and are used for illustrative purposes only.

The Applicants' invention has been described in the context of preferred and other embodiments and not every possible embodiment of the invention has been described. Obvious modifications and alterations to the described embodiments are available to those of ordinary skill in the art. The disclosed and undisclosed embodiments are not intended to limit or restrict the scope or applicability of the invention conceived of by the Applicants, but rather, in conformity with the patent laws, Applicants intends to protect all such modifications and improvements to the full extent that such falls within the scope or range of equivalent of the following claims.

What is claimed is:

1. A combination jar and disconnect tool comprising:

a housing having an end with threads of a first hand for mating with another threaded component;

a sleeve having threads of the first hand on one end for mating with another threaded component, the sleeve slidably disposed within the housing such that the threaded sleeve end is disposed on the tool at an end opposite from the housing threaded end;

a plurality of cooperating jarring surfaces disposed on the sleeve and housing;

a disconnect joint coupled to either the sleeve or the housing, the interface having threads of a hand opposite to the first handed threads;

an axial locking element that fixes the sleeve to the housing against relative axial movement;

an anti-rotation element that prevents relative rotation between the sleeve and the housing;

a rotational locking element that fixes the disconnect joint together against relative rotation;

wherein the axial locking element may be selectively unlocked to allow the sleeve to move axially relative to the housing to impart a jarring force; and wherein the rotational locking element may be unlocked so that relative rotation within the disconnect joint in a first hand tightening direction unscrews the disconnect joint.

2. The tool of claim 1, wherein the axial locking element comprises a tension ring, a shear pin or a combination thereof.

3. The tool of claim 1, wherein the axial locking element is releasable by increased fluid pressure.

4. The tool of claim 1, wherein the axial locking element is releasable and relockable.

5. The tool of claim 1 wherein the rotational locking element is releasable by increased fluid pressure.

6. The tool of claim 1, wherein the rotational locking element comprises one or more shear pins.

7. The tool of claim 1, wherein the anti-rotation element comprises a multi-sided sleeve surface and corresponding bushing.

8. The tool of claim 7, wherein the multi-sided sleeve surface is a hexagonal.

9. The tool of claim 8, wherein the anti-rotation element is releasable and relockable.

10. The tool of claim 1, further comprising a transducer that converts relative axial movement between the housing and the sleeve into relative rotational movement in the disconnect joint.

11. The tool of claim 10, wherein the transducer causes relative rotational movement in the disconnect joint when the sleeve and housing ends are jarred away from each other, jarred toward each other or a combination of both.

12. The tool of claim 11, wherein the transducer comprises a set of camming surfaces and one or more followers.

13. A method of freeing or disconnecting from stuck downhole equipment using the tool of claim 1 equipment, comprising:

providing a combination jar and disconnect tool proximal the stuck equipment;

releasing an axial lock on the tool;

jarring the stuck equipment at least one time;

releasing a rotational lock on the tool;

rotating a portion of the tool in direction to disconnect a portion of the tool that is coupled to the stuck equipment from the remainder of the tool.

14. The method of claim 13, wherein the axial lock is released by increasing the pressure in a well annulus to at least a predetermined lock release pressure.

15. The method of claim 13 wherein releasing the axial lock comprises shearing a shear screw system at a predetermined load.

16. The method of claim 13, wherein rotating the tool is accomplished by converting axial jarring movement of tool into rotational movement.

17. The method of claim 15 wherein rotation occurs on an up-jar stroke, a down-jar stroke or on both an up-jar and down-jar stroke.

18. The method of claim 16 further comprising removing the stuck equipment from the hole before the tool is fully disconnected from the stuck equipment.

19. A combination jar and disconnect tool comprising:

a housing having an pin end with threads of a first hand for mating with another threaded component;

a sleeve having threads of the first hand on a box end for mating with another threaded component, the sleeve slidably disposed within the housing such that the box end is disposed on the tool at an end opposite from the housing pin end;

a plurality of cooperating jarring surfaces disposed on the sleeve and housing;

a disconnect joint coupled to the housing to disconnect the pin end from the rest of the housing, the joint having threads of a hand opposite to the pin and box;

a shear pin system that fixes the sleeve to the housing against relative axial movement;

an anti-rotation element that prevents relative rotation between the sleeve and the housing at selected axial relationships between the sleeve and housing;

a rotational locking element that fixes the disconnect joint together against relative rotation;

wherein the axial locking element may be selectively unlocked to allow the sleeve to move axially relative to the housing to impart a jarring force; and wherein the rotational locking element may be selectively unlocked so that relative rotation within the disconnect joint in a first hand tightening direction unscrews the disconnect joint.

* * * * *